US010470590B2

(12) United States Patent
Wills et al.

(10) Patent No.: US 10,470,590 B2
(45) Date of Patent: Nov. 12, 2019

(54) BRACKET FOR PRODUCT DISPLAY GRID AND RELATED METHODS

(71) Applicant: Retail Space Solutions LLC, Milwaukee, WI (US)

(72) Inventors: Matthew Wills, Grafton, WI (US); Craig A. Fluegge, Menomonee Falls, WI (US); Eric Pollpeter, Cedarburg, WI (US)

(73) Assignee: Retail Space Solutions LLC, Milwaukee, WI (US)

( * ) Notice: Subject to any disclaimer, the term of this patent is extended or adjusted under 35 U.S.C. 154(b) by 0 days.

(21) Appl. No.: 15/896,681

(22) Filed: Feb. 14, 2018

(65) Prior Publication Data

US 2018/0228303 A1 Aug. 16, 2018

Related U.S. Application Data

(60) Provisional application No. 62/459,315, filed on Feb. 15, 2017.

(51) Int. Cl.
*A47F 5/08* (2006.01)
*A47F 5/13* (2006.01)
(Continued)

(52) U.S. Cl.
CPC ..... *A47F 5/0838* (2013.01); *A47B 57/406* (2013.01); *A47B 96/06* (2013.01);
(Continued)

(58) Field of Classification Search
CPC ..... A47F 5/0838; A47F 5/083; A47F 5/0884; A47F 5/13; A47F 5/08; A47F 5/01;
(Continued)

(56) References Cited

U.S. PATENT DOCUMENTS 2,309,851 A 2/1943 Kuhne
3,174,592 A * 3/1965 Berman ..... E04B 2/7818 211/134
(Continued)

FOREIGN PATENT DOCUMENTS

EP 567804 11/1993
EP 3042865 7/2016
(Continued)

OTHER PUBLICATIONS

European Patent Office, Partial European Search Report issued in European Patent Application No. 18275020.8, dated Jun. 4, 2018, 9 pp.
(Continued)

*Primary Examiner* — Jennifer E. Novosad
(74) *Attorney, Agent, or Firm* — Andrus Intellectual Property Law, LLP

(57) ABSTRACT

A product display system comprising an upright structure, a first rectangular grid comprising a plurality of cross members, a first bracket coupled to the grid, and a second bracket coupled to the grid. The first bracket comprising, a first engagement structure configured to detachably couple to the grid, and a second engagement structure configured to detachably couple to the upright structure. The second bracket comprising a first engagement structure configured to detachably couple to the grid, and a second engagement structure configured to detachably couple to a second grid.

15 Claims, 10 Drawing Sheets

(51) Int. Cl.
*A47F 5/10* (2006.01)
*A47B 57/40* (2006.01)
*A47B 96/06* (2006.01)

(52) U.S. Cl.
CPC ..... *A47F 5/083* (2013.01); *A47F 5/0884* (2013.01); *A47F 5/103* (2013.01); *A47F 5/13* (2013.01)

(58) Field of Classification Search
CPC ..... A47F 5/0807; A47F 5/101; A47F 5/103; A47B 96/06; A47B 57/06; A47B 57/16; A47B 57/40; A47B 57/406; A47B 57/42; A47B 55/02; A47B 96/068; A47B 96/07; A47B 96/14
USPC ..... 211/106, 87.01, 106.01, 103; 248/250, 248/248, 235, 220.21, 221.11, 225.21
See application file for complete search history.

(56) References Cited

U.S. PATENT DOCUMENTS 3,229,823 A * 1/1966 Hummer ..... A47F 5/13 211/181.1
3,294,351 A * 12/1966 Rollins, Jr. ..... A47B 96/028 211/90.03
3,486,632 A * 12/1969 Balch ..... A47F 5/00 211/106.01
3,495,717 A 2/1970 Lavin
3,627,247 A * 12/1971 Krikorian ..... A47B 57/42 108/108
3,765,344 A * 10/1973 Ferdinand ..... A47B 45/00 108/102
3,779,394 A * 12/1973 Bard ..... A47F 5/103 211/134
3,779,499 A 12/1973 Shell
3,853,293 A * 12/1974 Larson ..... A47F 5/0823 211/86.01
3,886,698 A * 6/1975 Raith ..... A47B 57/404 211/126.16
3,897,926 A 8/1975 Silver
D237,142 S 10/1975 Barnes
3,966,158 A 6/1976 Boundy
4,037,729 A * 7/1977 DeSisto ..... A47F 5/103 211/208
4,109,797 A * 8/1978 Brunette ..... A47F 5/12 108/108
4,127,196 A 11/1978 Boucher
4,234,094 A 11/1980 Jorgensen
4,340,144 A * 7/1982 Cousins ..... A47F 5/083 211/106
D267,606 S 1/1983 Vrignaud
4,366,906 A 1/1983 Joyce
4,401,222 A * 8/1983 Kulikowski ..... A47F 5/0025 211/94.01
4,405,051 A 9/1983 Thalenfeld
4,415,091 A * 11/1983 Wolff ..... E04B 2/7405 211/103
4,467,926 A * 8/1984 Percival ..... A47F 5/0823 211/106
4,501,369 A 2/1985 Fox
4,509,648 A 4/1985 Govang
4,542,832 A * 9/1985 Minick ..... A47B 55/02 211/106
4,550,893 A * 11/1985 Wiersema ..... A47B 57/42 211/103
4,583,648 A * 4/1986 Buffington ..... A47B 57/045 211/106
4,591,057 A * 5/1986 Garfinkle ..... A47F 5/0807 211/106
D285,168 S 8/1986 Van Arsdell
4,615,503 A 10/1986 Garfinkle
4,735,325 A * 4/1988 Remmers ..... A47B 96/068 211/107
4,832,298 A * 5/1989 Metcalf ..... A47F 5/083 211/59.1
4,842,230 A * 6/1989 Cobb ..... A47F 5/083 211/106
5,031,783 A 7/1991 Goudreau
5,038,943 A 8/1991 Reinke
5,097,968 A * 3/1992 Gregory ..... A47F 5/0838 206/338
5,188,326 A * 2/1993 Zich ..... A47B 57/40 248/220.41
5,236,163 A 8/1993 Valiulis
5,253,770 A 10/1993 Rosenthal
5,305,898 A * 4/1994 Merl ..... A47F 5/0807 211/103
5,326,062 A * 7/1994 Remmers ..... A47B 55/02 211/106
5,351,842 A * 10/1994 Remmers ..... A47B 96/028 108/152
5,379,976 A 1/1995 Degirolamo
5,398,824 A 3/1995 Wolff
5,415,370 A 5/1995 Valiulis
5,439,120 A * 8/1995 Brozak ..... A47F 5/0838 206/806
5,472,103 A * 12/1995 Merl ..... A47B 47/022 211/187
5,482,168 A * 1/1996 Welch ..... A47B 96/00 211/106
5,526,941 A * 6/1996 Ford ..... A47F 5/0869 211/103
5,641,081 A * 6/1997 Merl ..... A47B 47/022 211/103
5,769,247 A * 6/1998 Merl ..... A47B 47/022 211/103
5,769,248 A * 6/1998 Johnson ..... A47F 5/0807 211/103
5,855,283 A 1/1999 Johnson
5,868,263 A * 2/1999 McAllister ..... A47B 57/485 108/108
5,921,411 A * 7/1999 Merl ..... A47B 96/00 108/108
6,109,461 A * 8/2000 Kluge ..... A47B 57/30 211/103
6,241,107 B1 6/2001 Boyer
6,299,001 B1 * 10/2001 Frolov ..... A47F 5/01 211/106
6,471,079 B2 10/2002 Berlingieri
D467,792 S 12/2002 Zadak
6,497,331 B1 12/2002 Morandi
6,497,395 B1 * 12/2002 Croker ..... H02G 3/30 211/103
6,688,478 B2 * 2/2004 Miller, Jr. ..... A47F 1/12 211/118
6,726,035 B2 * 4/2004 Zadak ..... A47B 57/42 211/106
6,746,379 B1 6/2004 Brawner
D502,516 S 3/2005 Chen
D519,359 S 4/2006 Hoernig
7,128,223 B1 * 10/2006 Sarnoff ..... A47F 5/083 211/90.03
D547,164 S * 7/2007 Xayoiphonh ..... D8/363
7,270,242 B2 * 9/2007 Liu ..... A47B 47/024 211/189
D555,466 S 11/2007 Hennig
7,334,692 B2 * 2/2008 Black ..... A47B 47/025 211/106
D564,865 S * 3/2008 Johnson ..... D8/372
7,387,213 B1 * 6/2008 Smalley ..... A47B 57/482 211/106
7,497,344 B2 * 3/2009 Chen ..... A47B 57/40 108/108
7,954,656 B1 * 6/2011 Cuzzocrea ..... A47F 5/103 211/189
8,540,088 B2 * 9/2013 Brasher ..... A47F 5/083 211/106
9,119,471 B2 * 9/2015 Gonzalez ..... A47B 96/1408
9,178,343 B2 * 11/2015 Brouwer ..... H02G 3/0443

(56) References Cited

U.S. PATENT DOCUMENTS

2004/0084392 A1* 5/2004 Richter ..... A47F 5/0838 211/59.3
2005/0006541 A1* 1/2005 Magnusson ..... A47B 96/1416 248/235
2005/0056749 A1* 3/2005 Simard ..... A47B 57/34 248/248
2006/0278782 A1 12/2006 Lockwood
2007/0023375 A1* 2/2007 Fedewa ..... A47B 81/061 211/103
2007/0176065 A1* 8/2007 Schneider ..... A47B 57/045 248/235
2007/0187561 A1* 8/2007 Xayoiphonh ..... A47B 43/00 248/235
2008/0179267 A1* 7/2008 Johnson ..... A47F 5/083 211/87.01
2010/0300999 A1* 12/2010 Schwartzkopf ..... A47B 96/061 211/104
2012/0305504 A1* 12/2012 Currin ..... A47F 5/0838 211/45
2015/0313357 A1* 11/2015 David ..... A47B 47/0083 211/187
2017/0231388 A1* 8/2017 Will ..... A47B 95/008 211/106
2018/0228303 A1* 8/2018 Wills ..... A47F 5/0838

FOREIGN PATENT DOCUMENTS

FR 66717 8/1957
WO 2004000073 A1 12/2003
WO 2015084866 6/2015
WO 2016129669 8/2016
WO 2016178610 11/2016

OTHER PUBLICATIONS

Communication Pursuant to Article 94(3) EPC in corresponding European Application No. 18275020.8, dated Mar. 20, 2019.

* cited by examiner

BRACKET FOR PRODUCT DISPLAY GRID AND RELATED METHODS

CROSS REFERENCE TO RELATED APPLICATION

This application claims the benefit of U.S. Provisional Application No. 62/459,315, filed Feb. 15, 2017, which is hereby incorporated herein by reference in its entirety.

FIELD

This invention relates generally to product displays and, more particularly, to brackets for mounting grids for supporting product displays.

BACKGROUND

Product displays, such as merchandisers, are frequently used in retail environments to display products for sale. These product displays are frequently supported by wire grids or product display grids. Example product display grids are described in U.S. Pat. No. 5,769,248 "Product Display Grid System" assigned to DCI Marketing which is fully incorporated herein by reference. Wire grids are generally made of metal and are about 18 inches high and 48 inches wide. The grids are mounted to walls or uprights of a shelving system. Once the grids are mounted to the uprights, product displays are mounted to the grid. The grids sometime mounted to the uprights and/or wall by way of mounting brackets. Traditional brackets may be knocked off while trying to move the large, heavy grid into position. Additionally, the right side brackets may be accidentally placed to the left of the grid or vice versa.

It would be useful to have universal brackets capable of more firmly engaging grids in order to aid in grid installation.

BRIEF DESCRIPTION OF THE FIGURES

Embodiments of the invention are illustrated in the figures of the accompanying drawings in which.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Many variations of grid brackets are discussed herein and even further are contemplated in view of this disclosure. The brackets discussed herein are configured, and designed, to couple a grid to an upright structure, such as a shelving system, post, gondola and/or wall. The brackets generally comprise one or more first attachment structures configured to couple to the grid and one or more second attachment structures configured to couple to the upright structure.

Figure 1:
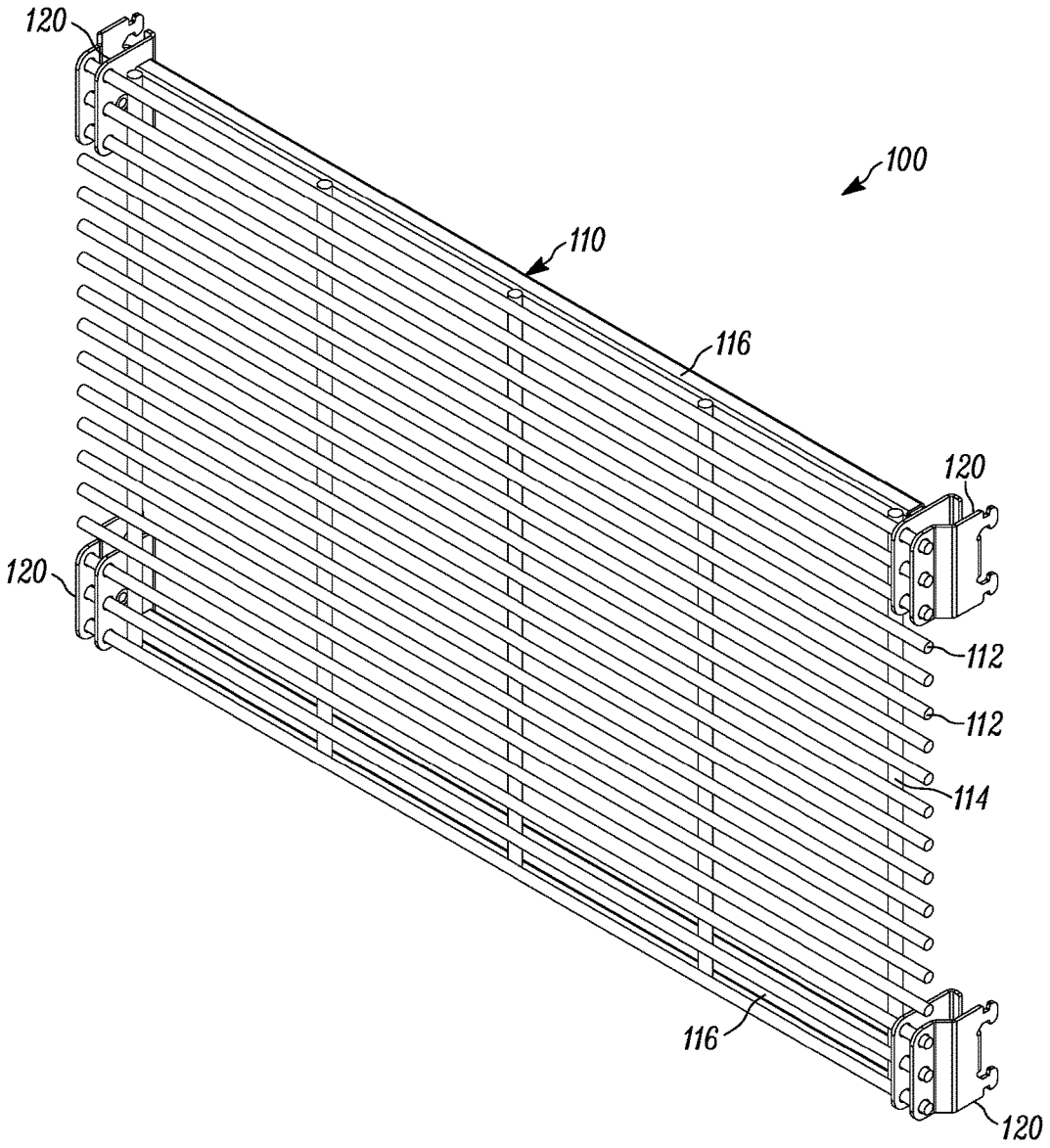
FIG. 1 is a perspective view of a product display assembly according to a first embodiment of the present invention.

FIG. 1 illustrates a product display 100 comprising a grid 110 mounted to uprights 102*a*/102*b* by brackets 120. The grid 110 is a metal wire grid comprising a series of cross-members 112 and vertical members 114. In a preferred embodiment, the grid 110 is a standard size to fit into most displays. Example standard sizes include 4 feet by 8 feet and 2 feet by 4 feet rectangles. Other standard sizes are also considered herein, such as metric sizes. In alternative embodiments, the grid is a custom size to fit a particular display.

The cross-members 112 of the grid 110 are cylindrical metal rods. In alternative embodiments, the cross-members 112 can have different shapes such as slats, rectangular prisms, triangular prisms, or fins. These cross members 112 are used to support a variety of product displays such as hooks, baskets, hangers, shelves, and/or merchandisers. Example grids and product displays are described in U.S. Pat. No. 5,769,248, titled "PRODUCT DISPLAY GRID SYSTEM", which is incorporated herein by reference in its entirety.

In addition to the cross-members 112, the grid 110 includes one or more horizontal members 116. The horizontal members 116 add rigidity to the grid 110 to reduce twisting and/or bending of the grid 110. In one form, horizontal members 116 are placed at the top and the bottom of the grid 110. In alternative forms, additional horizontal members 116 are spaced between the top and bottom. In still further alternatives, rigidity is alternatively or additionally provided by diagonal members.

In a preferred form, the horizontal members 116 and brackets 120 are sized such that pushing the brackets 120 on either end of a horizontal member 116 up flush against the ends of the horizontal member 116 perfectly spaces the brackets 120 to fit into corresponding upright structures.

Figure 2A:
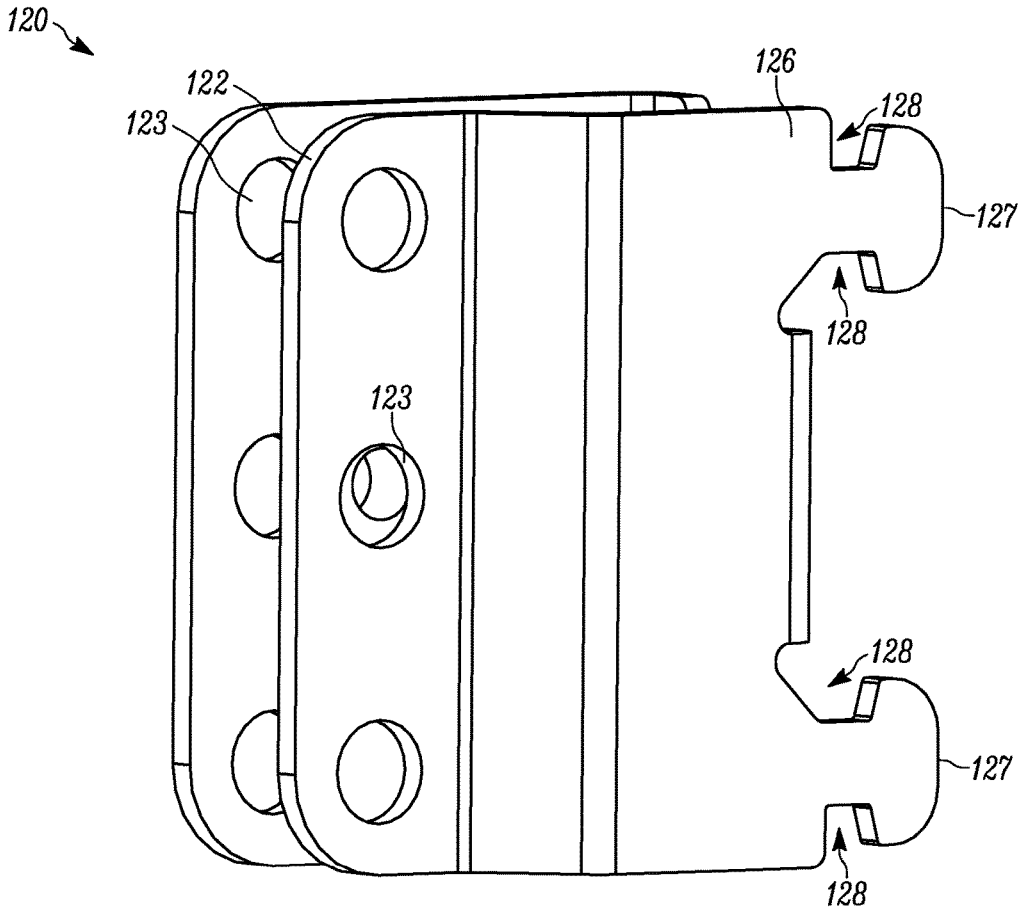
FIG. 2A is a front right perspective view of a bracket used in the assembly of FIG. 1.
Figure 2B:
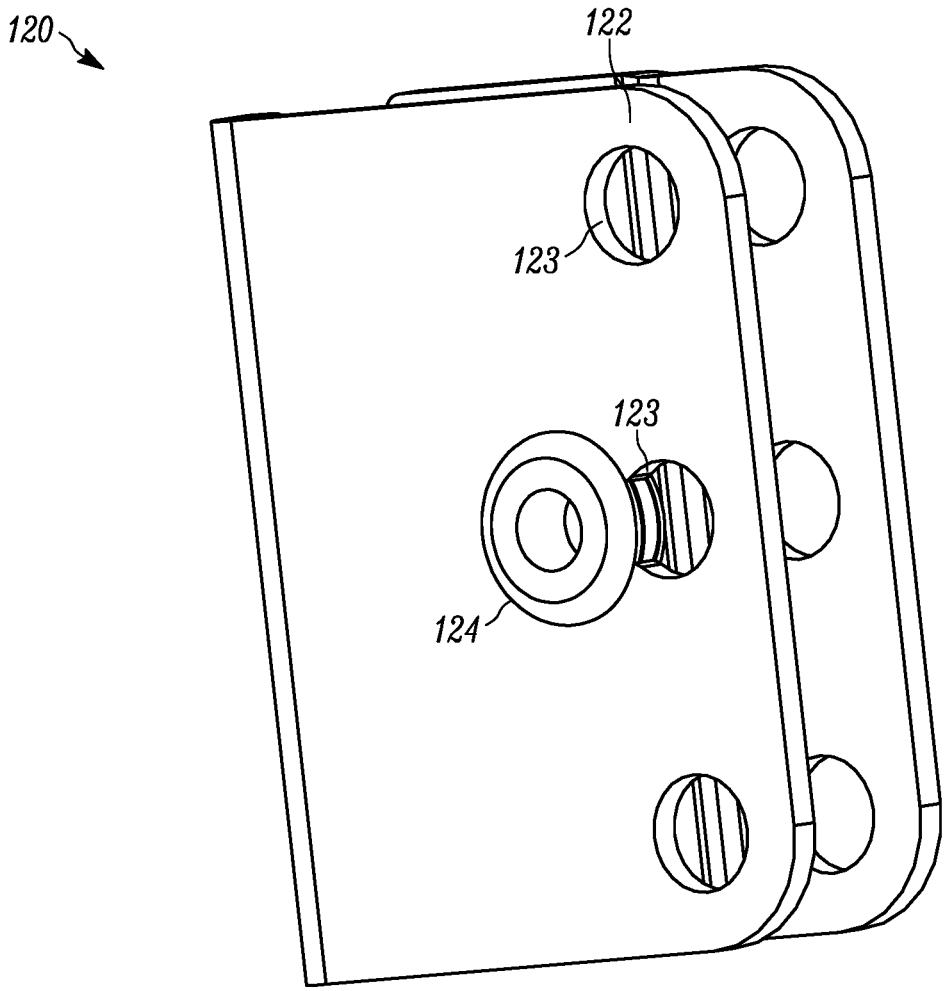
FIG. 2B is a front left perspective view of the bracket of FIG. 2A.
Figure 2C:
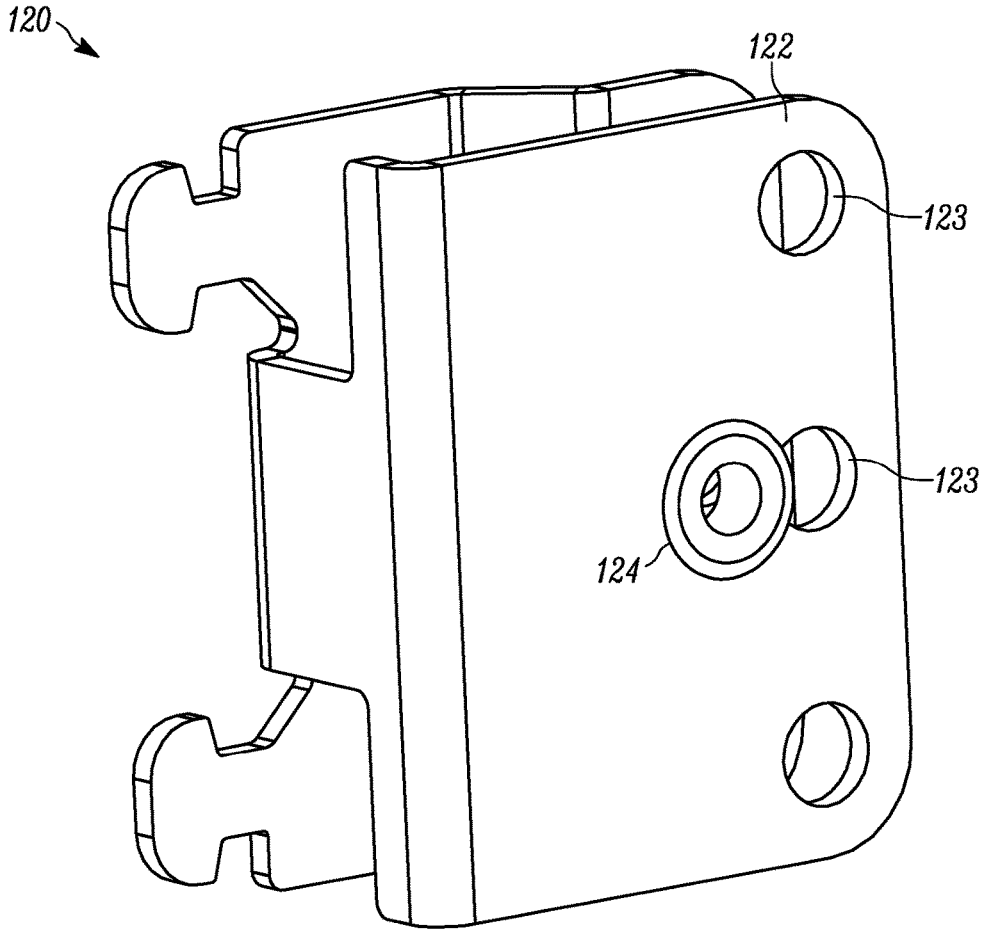
FIG. 2C is a back left perspective view of the bracket of FIGS. 2A-2B.

An isolated bracket 120 is shown in FIGS. 2A-2C. The bracket 120 includes a first engagement structure 122 and a second engagement structure 126. The first engagement structure 122 comprises one or more holes 123 sized to receive the cross-members of a grid. The bracket 120 is a universal bracket, meaning it is reversible so as to serve as either a left bracket or a right bracket. To this end, the bracket is symmetrical about a horizontal centerline so that it can be flipped about said centerline to change from a right side configuration to a left side configuration or vice versa.

As best shown in FIGS. 2B-2C, the bracket 120 includes a securing structure 124 configured to aid in securing the bracket 120 in place on the grid. In some forms, the securing structure 124 is a frictional device configured to increase friction between the bracket 120 and the grid. In the embodiment shown, the frictional device is a rubber grommet. The grommet is configured to be deformed when the bracket 120 is placed on a grid. This deformation increases the pressure with which the securing structure 124 presses against a cross-member of the grid, thus increasing the friction therebetween. In some forms, a plurality of securing structures are used.

In alternative forms, a force other than friction can be used to secure the bracket 120 in place on the grid. For example, one or more magnets, set screws, or a gear rack and ratchet combination can be used. In one form, the bracket 120 includes one or more magnets positioned to hold the bracket against the horizontal member of the grid so as to be properly spaced as described above.

The second engagement structure 126 is configured to detachably couple the bracket 120 to an upright structure, such as a shelving system, post, gondola and/or wall. In one common form, a shelving system or gondola comprises uprights having vertically oriented slots. The second engagement structure 126 includes one or more protrusions 127 sized to fit into the standard sized slots, and/or sized to fit into the specific size slots of a corresponding upright structure. Each protrusion 127 includes a recess 128 on each end spaced forward from the back, or distal portion, of the protrusion 127. The recesses 128 receive a portion of the upright structure at the bottom of the slot such that the rest of the protrusion 127 hooks over said bottom portion to prevent the bracket 120 from pulling out. The recesses 128 are on both ends of the protrusion 127 so that the bracket 120 can be flipped about a horizontal centerline and still function as described above. This reversibility makes the bracket 120 a universal bracket. In alternative embodiments, the recesses 128 fit over cross pieces or protrusions within the slots in addition to or instead of the bottom of the slot.

Figure 3A:
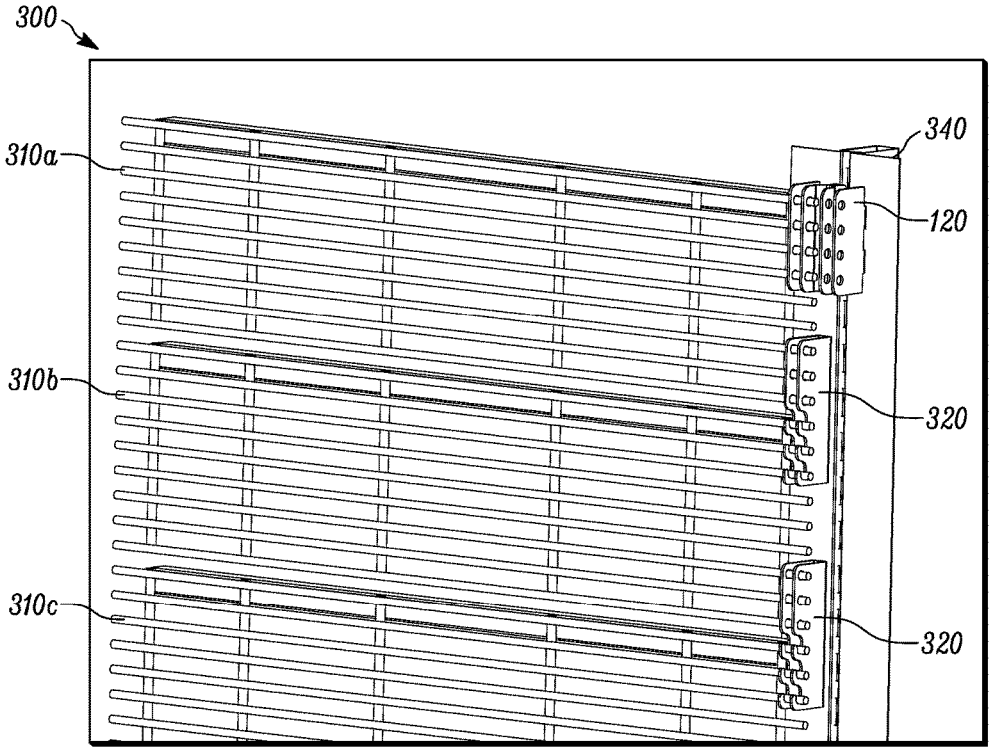
FIG. 3A is a perspective view of a product display assembly according to a second embodiment of the present invention.

The second engagement structure 126 is located on one side of the bracket 120 instead of centered. This enables two brackets 120 to be placed close together, one with the second engagement structure 126 on the right and the other with the second engagement structure 126 on the left, so that their respective second engagement structures 126 can be inserted into the same slot in an upright structure, as shown in FIG. 3A. Thus, the brackets 120 can be used in between adjacent grids.

Figure 3B:
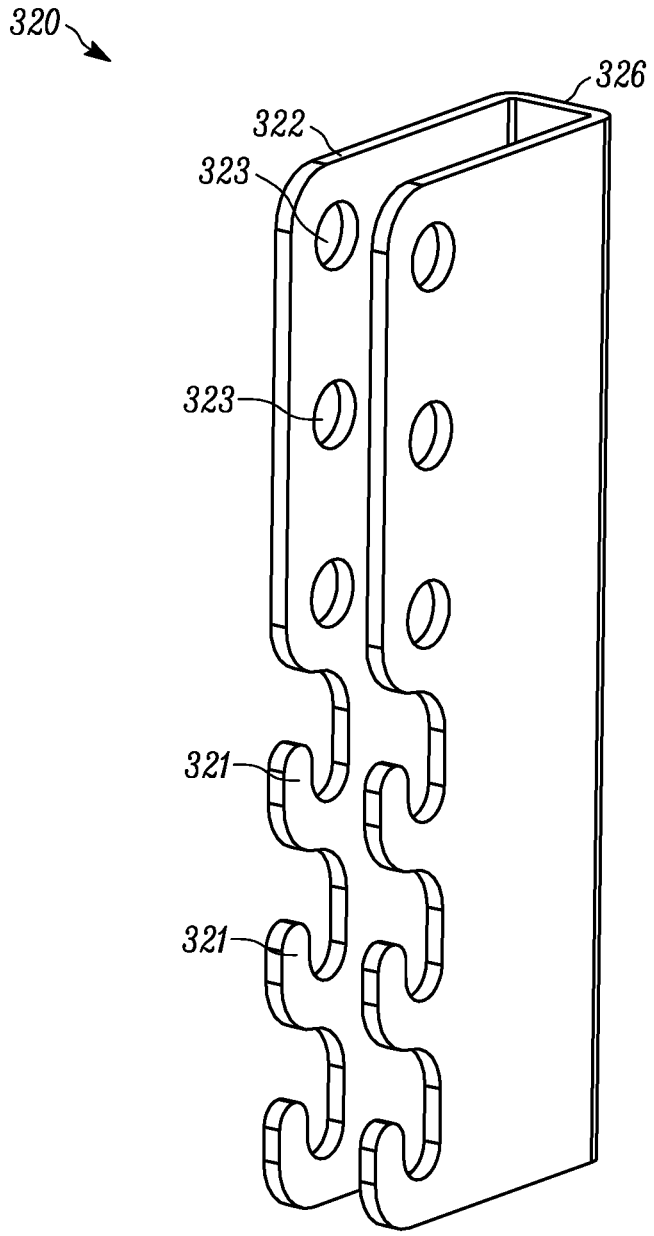
FIG. 3B is a front right perspective view of a bracket used in the assembly of FIG. 3A.
Figure 3C:
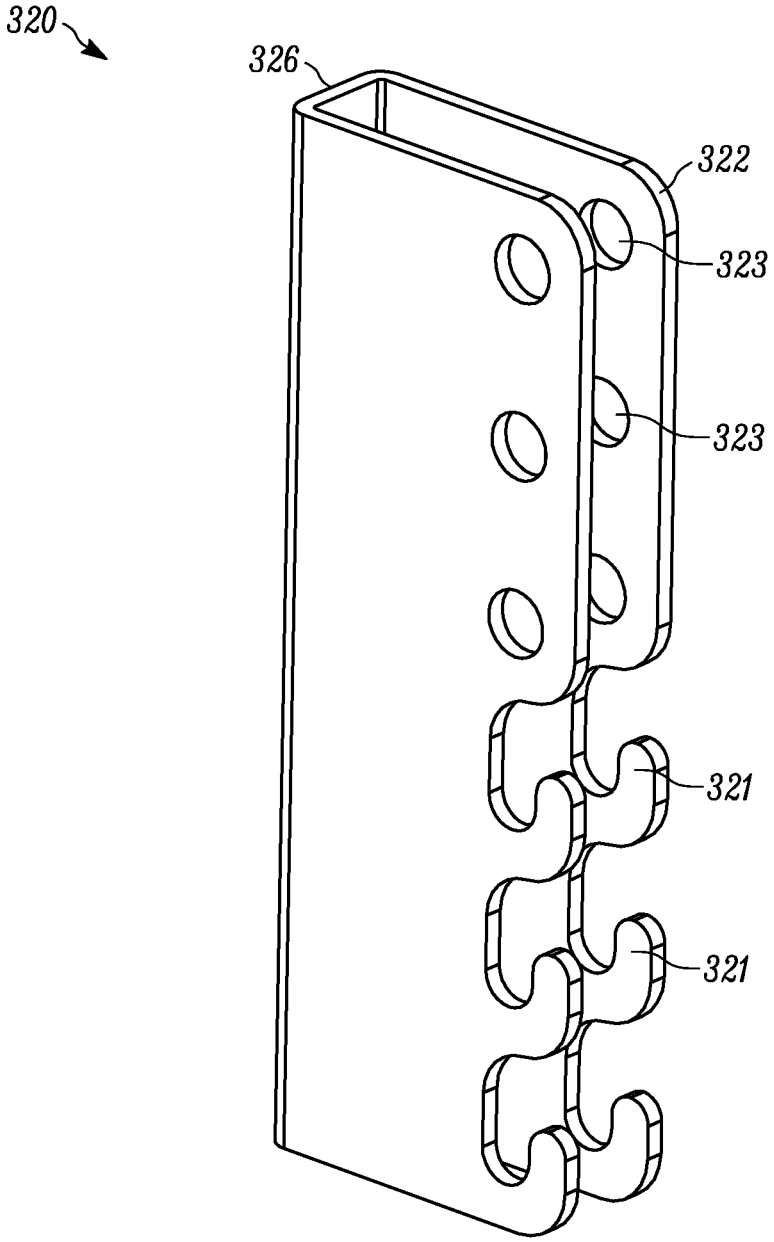
FIG. 3C is a front left perspective view of the bracket of FIG. 3B.
Figure 3D:
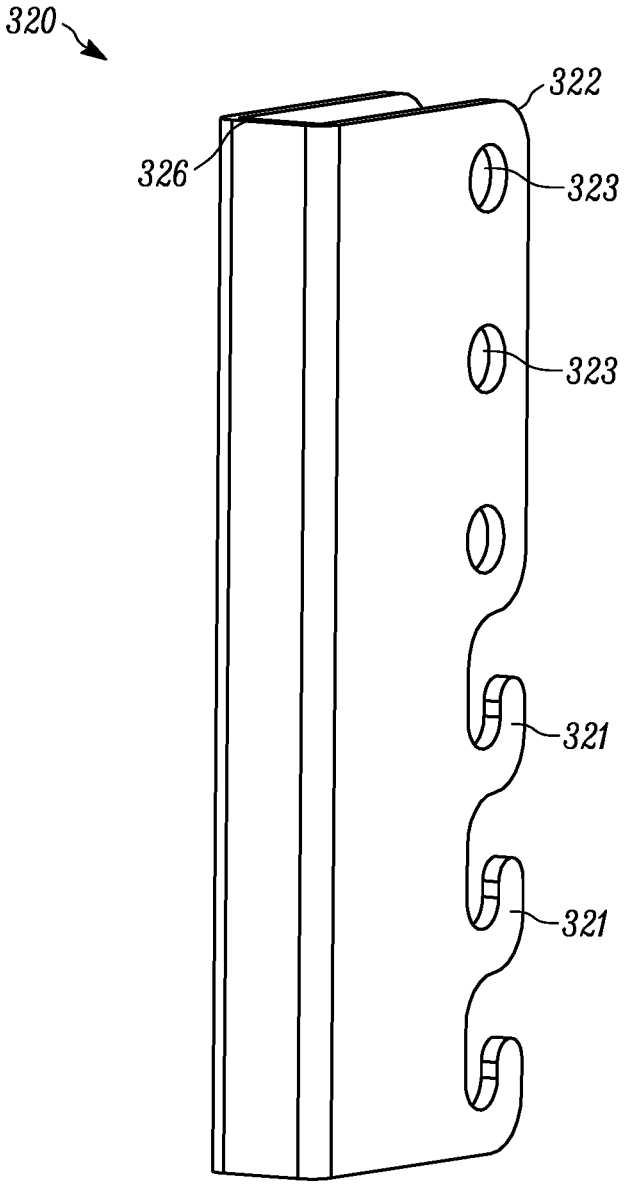
FIG. 3D is a back left perspective view of the bracket of FIGS. 3B-3C.

In alternative embodiments, the second engagement structure 126 is changed to correspond to different types of upright structures. Some examples of other engagement structures include the flat back design shown in FIGS. 3B-3D and the hook design shown in FIGS. 4A-4B. Both of these are described in greater detail below.

In operation, at least two brackets 120 are placed on a grid, one on the left and one on the right. In a preferred embodiment, four brackets 120 are used with one at each corner. The brackets 120 are pressed up against the horizontal members of the grid in order to properly space them, and the securing member 124 holds the brackets 120 in this properly spaced position. The grid is then lifted and attached to upright structures by inserting the protrusions 127 into corresponding slots.

FIG. 3A illustrates a product display 300 comprising a variety of brackets according to various embodiments of the present invention. The product display 300 includes a plurality of grids 310*a*-310*c* mounted to an upright 340 by brackets 120/320. The top most grid 310*a* is partially supported by a bracket 120 as described above. The second engagement structure 126 is inserted into the slot 342 of the upright 340.

The bottom of the top grid 310*a* and the remaining grids 310*b/c* are mounted to the upright by a second embodiment of a universal mounting bracket 320. A bracket 320 is shown in isolation in FIGS. 3B-3C. The bracket 320 includes a first engagement structure 322 to detachably couple the bracket 320 to one or more grids 310. The first engagement structure 322 includes one or more holes 123 for receiving a cross-member of a first grid 310*a* as well as one or more hooks 321 for receiving a cross-member of a second grid 310*b*. In the embodiment shown, there is no securing structure included in the bracket 320 as in the bracket 120, however alternative embodiments with one or more of the securing structures described below are considered herein. In an alternative embodiment, the holes 323 are replaced with downward facing hooks such that the bracket 320 hangs from the top grid 310*a*.

The bracket 320 is symmetrical about a vertical centerline. This symmetry makes the bracket 320 a universal bracket, meaning that it can be used on both the right side of the grids 310 as well as the left side. The bracket 320 further includes a flat back 326. The flat back 326 is configured to rest substantially flush against the upright 340. In some forms, the back 326 includes securing structure for attaching to the upright 340. The securing structure could be holes or slots through which the bracket 320 could be coupled by bolts, screws, nails, or posts. Alternatively or additionally, magnets, adhesive, clamps or combinations thereof could be used to couple the bracket 320 to the upright 340.

In the embodiment shown, no such securing structure is used to couple the bracket 320 to the upright 340. Instead, the bracket 320 secures the lower grid 310*b* to the upper grid 310*a*. The top most grid 310*a* of the column is coupled to the upright by use of a different type of bracket 120.

In operation, brackets 120 are placed on the top corners of the top grid 310*a*. Brackets 320 are placed on the bottom corners of the grid 310*a*. The brackets 320 are placed such that the bottom 3 cross members, or however many cross members correspond to the number of holes 323, are placed in the corresponding holes. In this position, the bottom half of the brackets 320 extend below the grid 310*a*. The grid 310*a* and brackets 120/320 are then lifted as an assembly and mounted by inserting the protrusions 127 of the brackets 120 into the slots 342 of a pair of uprights 340.

A second grid 310*b* is then prepared by placing brackets 320 at the bottom corners as was done with the top grid 310*a*. No brackets 120/320 are placed at the top corners. The grid 310*b* and brackets are lifted as an assembly and mounted to the display 300 by placing the top cross members over the hooks 321 of the brackets 320 coupled to the top grid 310*a*. This process is then continued downward with additional grids 310*c* until the bottom of the column is reached. The bottom most grid 310*c* does not have brackets 320 coupled to its bottom corners.

Figure 4A:
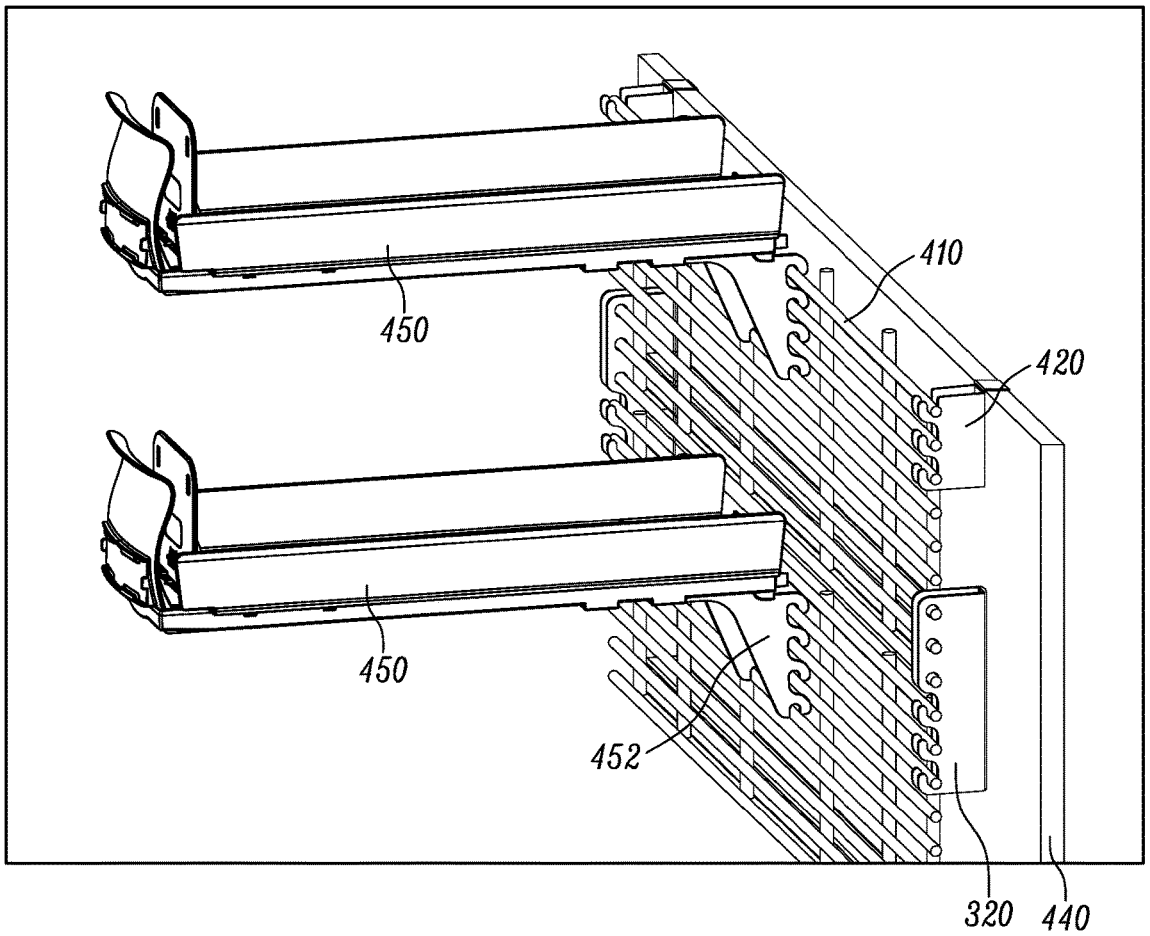
FIG. 4A is a perspective view of a product display assembly according to a third embodiment of the present invention.
Figure 4B:
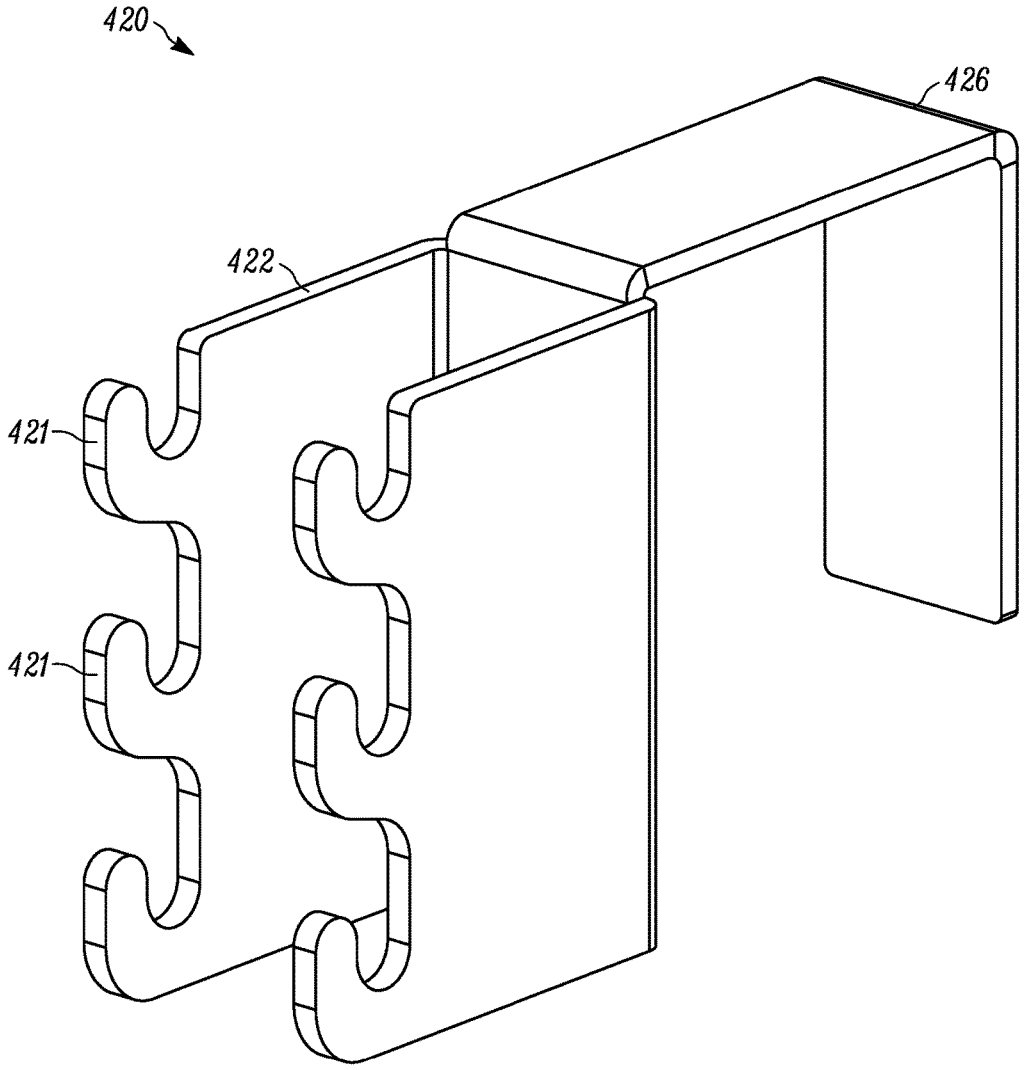
FIG. 4B is a front right perspective view of a bracket used in the assembly of FIG. 4A.

An alternative display 400 is shown in FIG. 4A. As with the display 300, the display 400 utilizes brackets 320 to chain together a column of grids 410. The brackets in FIG. 4A could differ slightly than the brackets 320 above in that they could have a different number of holes or be intended to receive a different number of grid bars or rods (e.g., only having enough holes 323 for two cross members (or bars or rods) and enough hooks for two additional cross-members (bars or rods) as opposed to the three plus three cross member design above. This is because, as discusses above, the number of holes and hooks can vary. A minimum number of holes 323 for one cross member and hooks 321 for one cross member are all that are needed. Additional holes 323 and hooks 321 serve to spread out the load over more cross members, and therefore are preferable for longer columns and/or columns intended to support more weight.

The top two corners of the top grid 410 are supported by brackets 420. The brackets 420 are shown in greater detail in FIG. 4B. The brackets 420 include a first engagement structure 422 having a plurality of hooks 421 configured to receive the top cross members of the grid 410. The brackets 420 further include a second engagement structure 426 configured to fit over the top of a wall portion or partition 440 as shown in FIG. 4A.

In operation, the brackets 420 are hung over the top of the partition 440. The brackets 320 are coupled to the bottom corners of a grid 410 as in the previous embodiment. The grid 410 and brackets 320 are then lifted as a unit and mounted on the partition 440 by placing the top cross members of the grid 410 into the hooks 421 of the brackets 420. A series of additional grids 410 can then be added to the bottom of the brackets 320 to form a column in substantially the same manner as the grids 310*b/c* were added to the display 300 above.

In an alternative form, the brackets 420 include holes instead of hooks 421. By this change, the brackets 420 are instead coupled to the grid 410 first and then attached to the partition 440 as an assembly as in the previous embodiments.

The product display 400 further includes merchandisers 450. The merchandisers shown are front facing merchandisers having a spring biased pusher. The merchandisers 450 include attachment structures 452 which comprise hooks configured to hook over the cross members of the grid 410 to hang the merchandisers there from. Exemplary merchandisers are described in International Patent Application PCT/US16/43354, titled "MERCHANDISER AND METHODS RELATING TO SAME", filed on Jul. 21, 2016, which is incorporated by reference herein in its entirety.

Alternatively to the rigid attachment structure 452 shown, merchandisers or other product displays may include adjustable attachment structures to provide for greater vertical adjustment through which more efficient vertical pack out can be achieved. Example adjustable grid mounts are described in U.S. Provisional Application No. 62/371,579, titled "ADJUSTABLE GRID MOUNT AND RELATED METHODS", which is incorporated by reference herein in its entirety.

Elements in the above embodiments have three digit numbers. The first digit references the embodiment and the last two digits reference the element. Elements sharing the same last two digits across multiple embodiments are assumed to share the same description except where expressly distinguished.

Features of the various embodiments described above can be interchanged with each other in any combination to create other embodiments which are contemplated herein. For instance, the bracket 420 can be altered to include the securing structure 124 of bracket 120. Additionally, the description of brackets or display assemblies above enables a person of ordinary skill in the art to make and use those embodiments. Therefor various methods of making and using the above-described embodiments are considered herein, such as a method of display products, a method of assembling a product display, and/or a method of making a bracket.

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

In addition to the above, it should be understood that several brackets, display systems, and methods relating to same are disclosed herein. For example, a bracket is disclosed with a body having a first engagement structure and a second engagement structure wherein the first engagement structure is configured to connect to a first grid structure and the second engagement structure is configured to connect to an upright structure and/or a second grid structure. Like the brackets of FIGS. 1A-2C, or the bracket of FIGS. 3A-D, or the brackets of FIGS. 4A-B. In some forms, the first engagement structure is configured to detachably couple to the first grid structure, the second engagement structure is configured to detachably couple to an upright structure, and the bracket further comprises a securing structure configured to increase friction between the first engagement structure and the first grid structure. The securing structure may comprise a deformable member positioned to be deformed by the grid structure when the grid structure is disposed at least partially within the first engagement structure.

In some forms, the second engagement structure may comprise at least one of a protrusion used to couple the bracket to the upright structure, (e.g., such as an insertable hook structure). In other forms, the second engagement structure may comprise a recess or hole used to couple the bracket to the upright structure (e.g., such as a mating recess for receiving a mating protrusion extending from the upright itself, or a fastener opening for receiving a fastener, such as a bolt, screw, rivet, etc.). In still other forms, the second engagement structure may comprise a fastener used to couple the bracket to the upright structure (e.g., such as a bolt, screw, rivet, magnet, adhesive, etc.).

In some of the forms shown above, the first grid structure are horizontal rod or bar ends extending from a larger grid assembly and the first engagement structure comprises a plurality of substantially enclosed holes formed in the bracket for receiving the rod or bar ends, and the second engagement structure comprises at least one hook shaped protrusion for engaging a mating slot in the upright structure.

In some forms, the bracket may further define an opening proximate at least one of the substantially enclosed holes and having a deformable securing structure disposed therein to induce friction on at least one of the rod or bar ends disposed within the first engagement structure. In a preferred form, the deformable securing structure is a plastic or rubber grommet that is aligned to overlap with the substantially enclosed hole proximate the bracket opening containing the deformable structure. In this way, when the rod or bar end is inserted into the enclosed hole proximate the bracket opening containing the deformable structure, the deformable structure induces friction against the rod or bar end causing the bracket to be more securely connected to the rod or bar end and therefore the grid assembly itself. This makes it easier to position the brackets on the grid assembly in a desired orientation so that the grid assembly can be connected in the manner desired (e.g., connecting it to a slot in a gondola upright, connecting it to the top of an upright wall via a u-shaped bracket, etc.

In some forms, the bracket body is generally U shaped having a first body portion positioned substantially parallel to a second body portion with the first and second body portions being interconnected via an intermediate body portion, with the first engagement structure comprising a plurality of holes formed in each of the first and second body portions and each hole on the first body portion aligned with a corresponding hole on the second body portion, and the second engagement structure comprising a plurality of hook shaped protrusions extending from either one of the first and second body portions and/or from the intermediate body portion.

In other forms, the bracket may be used to interconnect grid assemblies or allow one grid assembly to be suspended by the other rather than be used to suspend the grid assemblies from an upright. In yet other forms, it may do both (e.g., interconnect the grid assemblies and connect them to the upright).

In one form, the first grid structure comprises a first set of horizontal rod or bar ends extending from a first grid assembly and the second grid structure comprises a second set of horizontal rod or bar ends extending from a second grid assembly and the first engagement structure comprises a plurality of substantially enclosed holes formed in the bracket for receiving the first set of horizontal rod or bar ends in a lateral direction only, and the second engagement structure comprises a plurality of open-faced channels formed in the bracket for receiving the second set of horizontal rod or bar ends in either the lateral direction or a direction transverse the lateral direction due to the open-faced channel arrangement of the second engagement structure so that the second grid structure can be suspended from the first grid structure via the bracket.

The invention claimed is:

1. A bracket comprising:

a body having a first engagement structure and a second engagement structure wherein the first engagement structure is configured to connect to a grid structure and the second engagement structure is configured to connect to an upright structure;

wherein the body is generally U-shaped having a first body portion positioned substantially parallel to a second body portion with the first and second body portions being interconnected via an intermediate body portion;

wherein the first engagement structure comprises a plurality of substantially enclosed holes formed in at least one of the first and second body portions for receiving rod or bar ends of the grid structure;

wherein the second engagement structure comprises at least one hook-shaped protrusion for engaging a mating slot in the upright structure and supporting the bracket therefrom, the at least one hook-shaped protrusion extending from at least one of the first body portion, the second body portion, and the intermediate body portion; and wherein the at least one hook-shaped protrusion comprises two recesses that open in opposite directions and are vertically aligned with one another.

2. The bracket of claim 1 wherein the first engagement structure is configured to detachably couple to the grid structure, the second engagement structure is configured to detachably couple to the upright structure, and the bracket further comprises a securing structure configured to increase friction between the first engagement structure and the grid structure.

3. The bracket of claim 2 wherein the securing structure comprises a deformable member positioned to be deformed by at least one of the rod or bar ends in response to the at least one of the rod or bar ends being disposed within at least one of the substantially enclosed holes.

4. The bracket of claim 1 further comprising an opening proximate at least one of the substantially enclosed holes and having a deformable securing structure disposed therein adapted to increase friction on at least one of the rod or bar ends disposed within the at least one of the substantially enclosed holes.

5. The bracket of claim 4 wherein the deformable securing structure is a plastic or rubber grommet that is aligned to overlap with the at least one of the substantially enclosed holes proximate the opening containing the deformable securing structure.

6. The bracket of claim 4 wherein the opening adjoins the at least one of the substantially enclosed holes, and the deformable securing structure extends at least partially into the at least one of the substantially enclosed holes.

7. The bracket of claim 1 wherein the substantially enclosed holes are formed in each of the first and second body portions, and each hole on the first body portion is aligned with a corresponding hole on the second body portion.

8. The bracket of claim 1 wherein the at least one hook-shaped protrusion extends from only one of the first and second body portions.

9. The bracket of claim 1 wherein the bracket is symmetrical about a horizontal centerline thereof.

10. A bracket comprising:

a body having an engagement structure and at least one hook;

wherein the engagement structure has at least one substantially enclosed hole sized to receive a cross member of a first grid structure;

wherein the at least one hook is configured to connect to at least one of an upright structure and a second grid structure; and further comprising an opening adjoining the at least one substantially enclosed hole, the opening having a deformable securing structure disposed therein, the deformable securing structure extending at least partially into the at least one substantially enclosed hole and being adapted to increase friction on the cross member in response to the cross member being disposed at least partially within the at least one substantially enclosed hole.

11. The bracket of claim 10 wherein the engagement structure is configured to detachably couple to the first grid structure, and the at least one hook is configured to detachably couple to the upright structure.

12. The bracket of claim 10 wherein the deformable securing structure is a plastic or rubber grommet.

13. The bracket of claim 10 wherein the body is generally U-shaped having a first body portion positioned substantially parallel to a second body portion with the first and second body portions being interconnected via an intermediate body portion, with the engagement structure comprising a plurality of holes, including the at least one substantially enclosed hole, formed in each of the first and second body portions and each hole on the first body portion aligned with a corresponding hole on the second body portion, and further comprising a plurality of hooks, including the at least one hook, extending from at least one of the first body portion, the second body portion, and the intermediate body portion.

14. The bracket of claim 13 wherein the plurality of hooks extends from only one of the first and second body portions.

15. The bracket of claim 10 wherein the at least one hook comprises two recesses that open in opposite directions and are vertically aligned with one another.

* * * * *